US007566117B2

(12) United States Patent
Kanda

(10) Patent No.: US 7,566,117 B2
(45) Date of Patent: Jul. 28, 2009

(54) INKJET RECORDING HEAD AND INKJET RECORDING DEVICE

(75) Inventor: Torahiko Kanda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 448 days.

(21) Appl. No.: 11/115,054

(22) Filed: Apr. 26, 2005

(65) Prior Publication Data

US 2006/0098054 A1 May 11, 2006

(30) Foreign Application Priority Data

Nov. 5, 2004 (JP) ..... 2004-322341

(51) Int. Cl.
*B41J 2/05* (2006.01)
*B41J 2/04* (2006.01)

(52) U.S. Cl. ..... 347/65; 347/54

(58) Field of Classification Search ..... 347/54, 347/57, 67, 68, 65
See application file for complete search history.

(56) References Cited

U.S. PATENT DOCUMENTS 4,336,544 A * 6/1982 Donald et al. ..... 347/54
5,909,230 A * 6/1999 Choi et al. ..... 347/54
5,988,799 A * 11/1999 Abe et al. ..... 347/68
6,036,105 A * 3/2000 Sanada et al. ..... 239/104

FOREIGN PATENT DOCUMENTS

| | | |
|---|---|---|
| JP | 9-327918 | 12/1997 |
| JP | 2003-118114 | 4/2003 |
| JP | 2003-220702 | 8/2003 |
| JP | 2004-34710 | 2/2004 |

* cited by examiner

*Primary Examiner*—Stephen D Meier
*Assistant Examiner*—Geoffrey Mruk
(74) *Attorney, Agent, or Firm*—Fildes & Outland, P.C.

(57) ABSTRACT

The present invention provides an inkjet recording head and inkjet recording device which can eject a high viscosity ink at ordinary temperature. The inkjet recording head has a nozzle portion ejecting an ink drop; an ink flow path member including the nozzle portion; and a driving section moving the ink flow path member in an ink drop ejecting direction and an opposite direction. The driving section moves the ink flow path member in the ink drop ejecting direction, and applies inertia in the ejecting direction to internal ink by one of suddenly stopping the ink flow path member and moving the ink flow path member in the opposite direction, and makes the ink drop be ejected from the nozzle portion.

10 Claims, 8 Drawing Sheets

INKJET RECORDING HEAD AND INKJET RECORDING DEVICE

CROSS-REFERENCE TO RELATED APPLICATION

This application claims priority under 35 USC 119 from Japanese Patent Application No. 2004-322341, the disclosure of which is incorporated by reference herein.

BACKGROUND OF THE INVENTION

1. Field of the Invention

The present invention relates to an inkjet recording head and an inkjet recording device.

2. Description of the Related Art Water-based inkjet printers which are currently on the market utilize dye inks or pigment inks generally having a viscosity of around 5 cps, and on the order of 10 cps at most. It is known that the printing performance can be improved by increasing the viscosity of the ink, for reasons such as: preventing the ink from bleeding when the ink lands on a medium, an increase in the optical color density, drying in a short period of time and suppressing of swelling of the medium due to a reduction in the amount of water contained, the large number of degrees of freedom in designing, in total, such high quality inks, and the like.

On the other hand, when ejecting a high viscosity ink, a high-output pressure generating mechanism is needed, which leads to problems such as an increase in cost and the size of the head, and the like. There has conventionally been known a technique of providing a heater separately at an ejector in order to forcibly lower the viscosity of the ink at the time of ejecting the ink (see, for example, Japanese Patent Application Laid-Open (JP-A) No. 2003-220702, FIG. 1 and pages 4 through 6). However, the aforementioned method of heating the ink has the fundamental problem of accelerating deterioration of the ink and damage to the flow path. Further, the inks that can be used therewith are limited to those which do not deteriorate due to heat.

There has also been disclosed a technique in which flowing of the ink in the reverse direction at the time when the ink is ejected is suppressed by a beam-shaped valve, and inks of higher viscosities are ejected (see, for example, JP-A No. 9-327918, FIG. 1 and pages 8 through 9).

The following are disclosed as methods of increasing the power of the pressure generating mechanism itself by utilizing buckling bending by which large deformation can be obtained: a technique using a diaphragm-shaped actuator which deforms due to the difference in the thermal expansions of the actuator and a heat generating body layer (see, for example, JP-A No. 2003-118114, FIG. 3 and pages 4 through 5), and a technique utilizing a cantilevered, beam-shaped actuator of a similar structure (see, for example, JP-A No. 2004-34710, FIG. 13 and pages 6 through 8).

For example, in an inkjet recording head 100 shown in FIGS. 8A and 8B, by deforming an actuator 102 as from FIG. 8A to FIG. 8B, pressure is suddenly applied to ink 101 within an ink chamber 106, and the ink 101 is ejected as an ink drop 108 from a nozzle 104.

However, even in the above-described conventional techniques, it is very difficult to stably eject, at ordinary temperature, high viscosity inks of 50 to 100 cps which greatly exceed a viscosity of 10 cps.

SUMMARY OF THE INVENTION

The present invention provides an inkjet recording head which addresses these disadvantages, and, in particular, which can eject high viscosity inks of the order of 50 to 100 cps at ordinary temperature. More specifically, the present invention provides an inkjet recording head and inkjet recording device which make an ink drop inertially separate from a nozzle by applying compression and rotational movement to a beam and utilizing the sharp vertical movement at the time when the direction of buckling bending reverses.

In view of the aforementioned, the present invention provides an inkjet recording head and an inkjet recording device which can eject a high viscosity ink at ordinary temperature.

An inkjet recording head of a first aspect of the present invention has: a nozzle ejecting an ink drop; an ink flow path member including the nozzle; and a driving section moving the ink flow path member in an ink drop ejecting direction and an opposite direction, wherein, after the driving section moves the ink flow path member in the ink drop ejecting direction, the driving section suddenly stops the ink flow path member or moves the ink flow path member in the opposite direction, thereby applying inertia in the ejecting direction to internal ink and making the ink drop be ejected from the nozzle.

The above-described structure uses a method in which, after the ink flow path member, at which the nozzle is provided, moves, the ink flow path member is suddenly stopped or reversed, and the ink drop is thereby inertially separated from the nozzle and ejected. Therefore, as compared with a conventional thermal or piezo system or the like, even inks of high viscosities can be ejected.

An inkjet recording head of a second aspect of the present invention has: a nozzle ejecting an ink drop; an ink flow path member including the nozzle; a beam member joined to the ink flow path member or including the ink flow path member; holding members holding both ends of the beam member; and a rotary encoder supporting one of or both of the holding members so as to be freely rotatable in an ink drop ejecting direction, and compressing and rotating the beam member, wherein, due to the holding member being supported so as to be offset from a rotational center of the rotary encoder, the beam member is bucklingly reversely deformed due to rotation of the rotary encoder, and inertia in the ejecting direction is applied to ink within the ink flow path member, and the ink drop is ejected from the nozzle.

In the above-described structure, the absence/presence of buckling reversal of the beam member, i.e., the absence/presence of expulsion of the ink drop, can be controlled by the amount of compression applied to the beam member, i.e., the amount of rotation of the encoder.

An inkjet recording head of a third aspect of the present invention has: a nozzle ejecting an ink drop; an ink flow path member including the nozzle; a beam member joined to the ink flow path member or including the ink flow path member, and disposed so as to be bent in advance in a direction of being concave in an ink drop ejecting direction; and an actuator flexing the beam member in a direction of being convex in the ink drop ejecting direction, wherein the actuator bucklingly reverses the beam member from the direction of being concave in the ink drop ejecting direction to the direction of being convex in the ink drop ejecting direction, and applies inertia in the ejecting direction to ink within the ink flow path member, thereby making the ink drop be ejected from the nozzle.

In the above-described structure, the beam member, to which is applied preliminary deformation such that the beam member is concave in the ejecting direction, is bucklingly deformed in the convex direction by the actuator, and the ink drop is ejected. In this way, a high viscosity ink can be ejected by a simple structure.

An inkjet recording device of a fourth aspect of the present invention uses the inkjet recording head of the first through the third aspects of the present invention.

In the present invention having the above-described structure, a high viscosity ink can be ejected onto a recording medium. As compared with conventional inkjet recording devices, recording of excellent quality and without bleeding can be carried out.

BRIEF DESCRIPTION OF THE DRAWINGS

Embodiments of the present invention will be described in detail based on the following figures, wherein.

DETAILED DESCRIPTION OF THE INVENTION

Figure 1A:
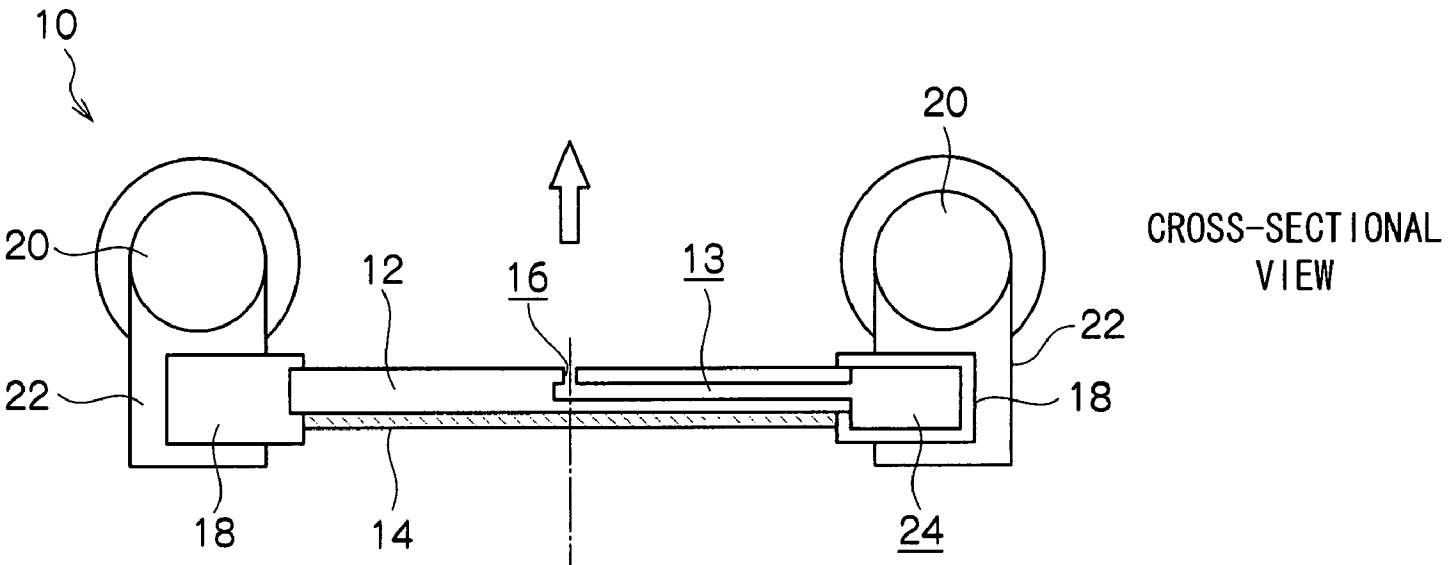
FIGS. 1A and 1B are drawings showing an inkjet recording head relating to a first embodiment of the present invention.
Figure 1B:
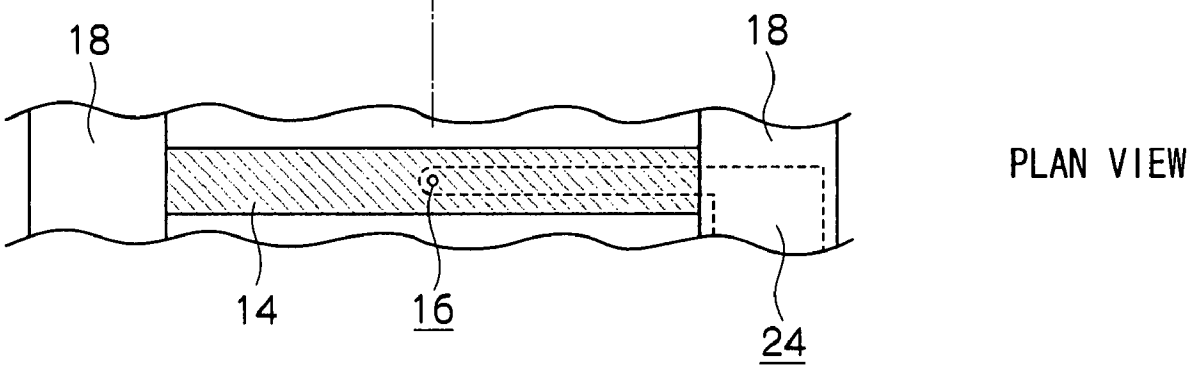

An inkjet recording head relating to a first embodiment of the present invention is shown in FIGS. 1A and 1B.

As shown in FIGS. 1A and 1B, an inkjet recording head 10 is structured such that an ink flow path member 12 and a beam member 14 are joined together, and holding members 18 support the both ends thereof. The ink flow path member 12 has an ink flow path 13 at the interior thereof, and has a nozzle 16 at the substantial center in the longitudinal direction thereof. The beam member 14 supports the ink flow path member 12. The ink flow path member 12 can flex in an ink ejecting direction (the direction of the white arrow in FIG. 1A) and the direction opposite thereto. The ink flow path member 12 ejects ink, which is supplied from an ink pool 24 and passes through the ink flow path 13 and reaches the nozzle 16, as an ink drop in the ejecting direction by inertia.

As described above, the ink which is used herein has a very high ink viscosity, and specifically, is a high viscosity ink whose viscosity greatly exceeds 10 cps (e.g., 50 to 100 cps), for reasons such as preventing the ink from bleeding when the ink lands on a medium, an increase in the optical color density, drying in a short period of time and suppressing of swelling of the medium due to a reduction in the amount of water contained, the large number of degrees of freedom in designing, in total, such high quality inks, and the like.

The holding members 18 are fixed to arms 22 provided at rotary encoders 20. The holding members 18 are pushed from both sides at positions which are offset from the rotational centers of the rotary encoders 20 by the lengths of the arms 22, or force in a bending direction is applied to the holding members 18 such that the holding members 18 flex the ink flow path member 12, which is connected to the beam member 14, in the ink ejecting direction or the opposite direction.

As shown in FIG. 1B, the holding members 18 may be a ladder-shaped structure in which plural ink flow path members 12 are provided at the holding members 18.

Actual operation will be described hereinafter.

Figure 2:
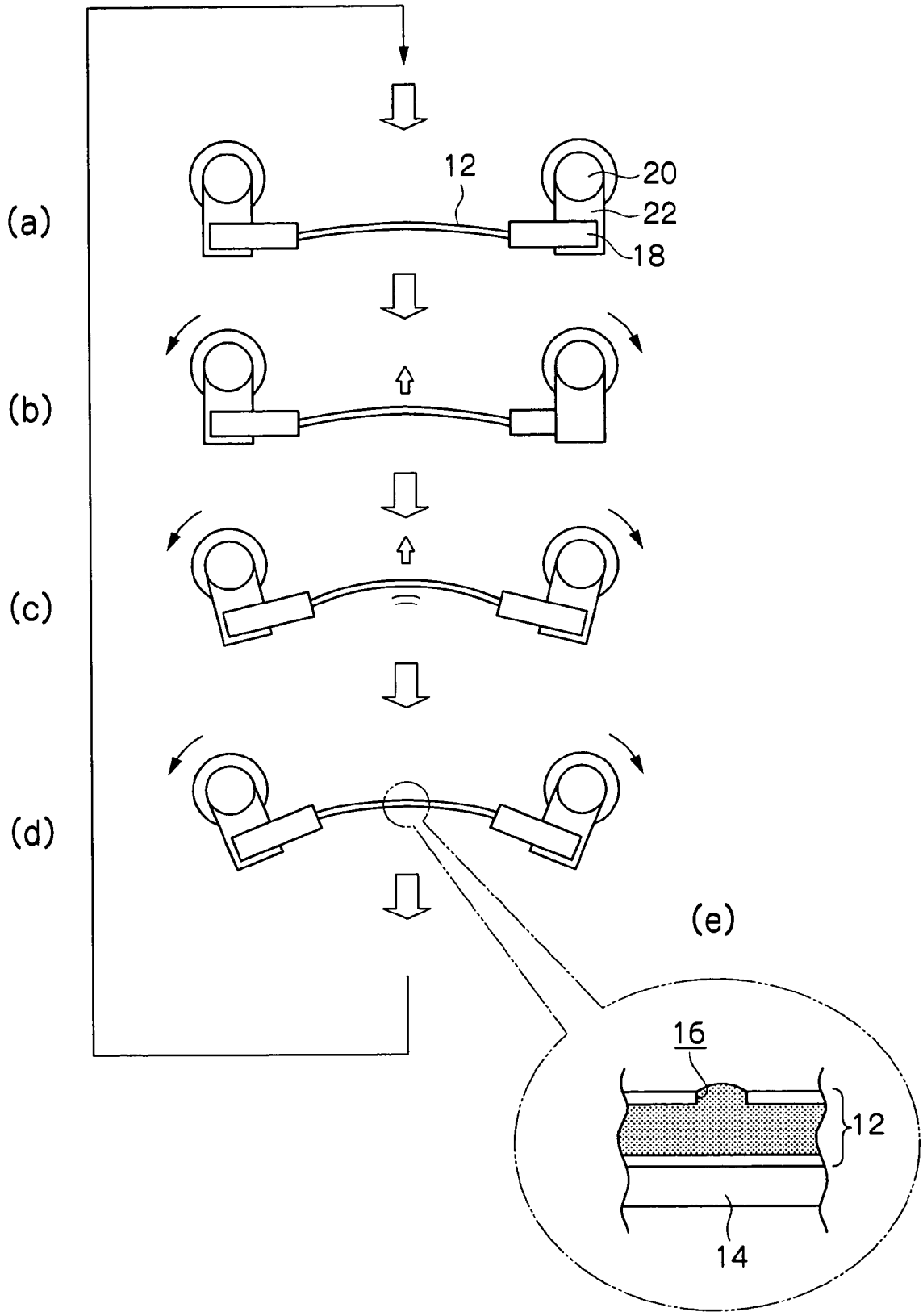
FIG. 2 is a drawing showing operation of the inkjet recording head relating to the first embodiment of the present invention.

As shown in FIG. 2(*a*), the ink flow path member 12 is in a state of being flexed in advance in the ink ejecting direction (upward in the drawing). Given that the angles of the rotary encoders 20 in this state are 0°, when the rotary encoders 20 are rotated in the direction of the arrows by, for example, 0° to +20° as shown in FIG. 2(*b*), the ink flow path member 12 only flexes in the ink ejecting direction as shown in FIGS. 2(*c*) and 2(*d*). The ink flow path member 12 always continues to be convex in the ink ejecting direction, until the amount of flexure reaches that in FIG. 2(*d*) which is the maximum.

Namely, during the time that the ink flow path member 12 is displaced from FIG. 2(*a*) to FIG. 2(*d*), sufficient acceleration in the ejecting direction is not applied to the ink in the ink flow path member 12. Therefore, the ink is not ejected as an ink drop from the nozzle 16 (refer to the enlarged view of FIG. 2(*e*)).

Figure 3:
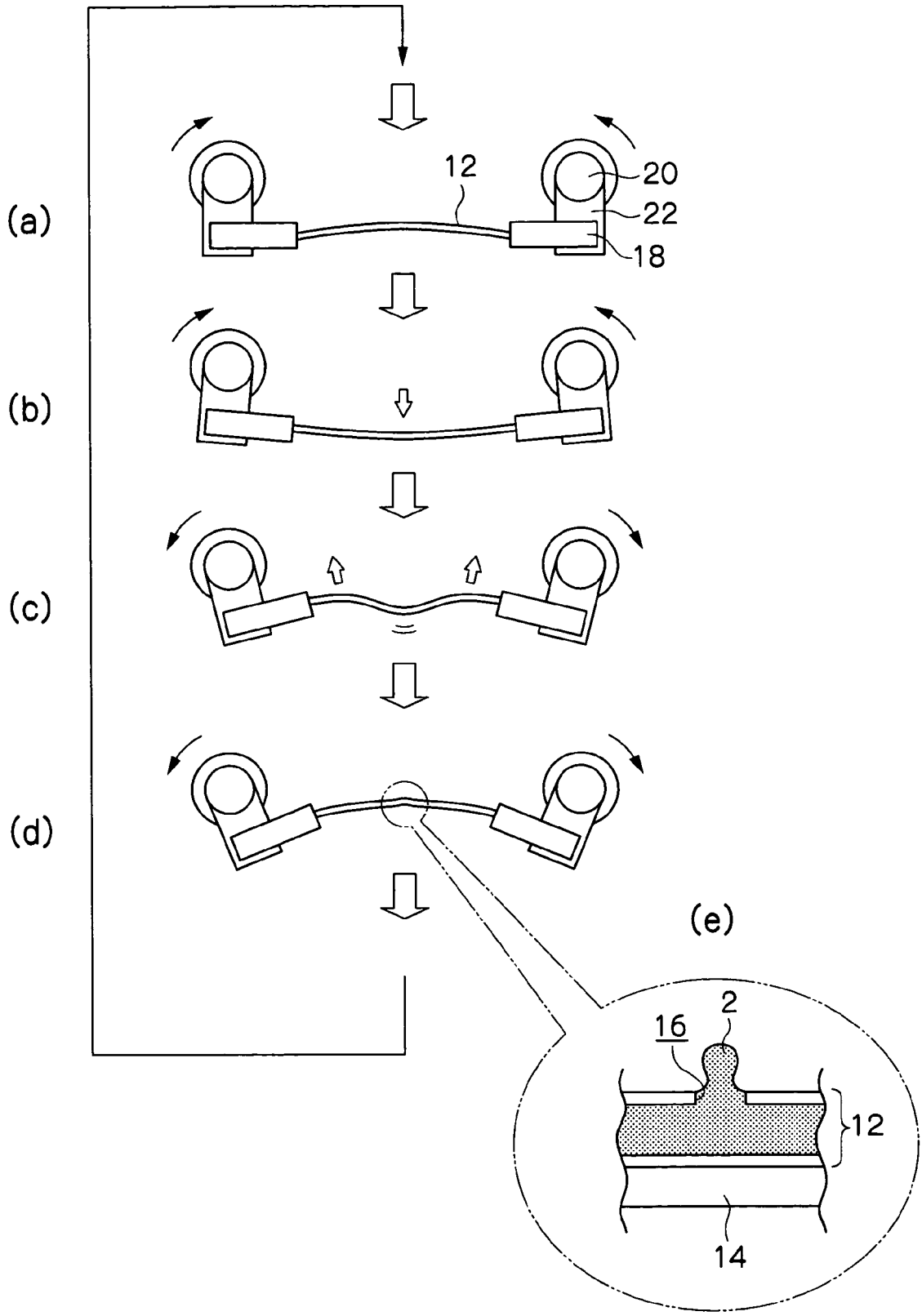
FIG. 3 is a drawing showing operation of the inkjet recording head relating to the first embodiment of the present invention.

On the other hand, as shown in FIG. 3(*a*), even if the ink flow path member 12 is in a state of being flexed in advance in the ink ejecting direction (upward in the figure), when the rotary encoders 20 are rotated −5° for example in the opposite rotational direction (in the directions of the arrows in the drawing), the flexing direction of the ink flow path member 12 changes (FIG. 3(*b*)) from convex to concave in the ink ejecting direction.

Next, in FIG. 3(*c*), when, from here, the rotary encoders 20 are again rotated forward (in the directions of the arrows in the drawing) by −5° to +° , the flexing direction of the ink flow path member 12 changes gradually, from near the rotary encoders 20, to convex in the ejecting direction (upward in the drawing). When this change approaches the center from the both ends, a sudden buckling reversal occurs at the ink flow path member 12 (or the beam member 14) at a given point, and the ink flow path member 12 (or the beam member 14) suddenly deforms in the ink ejecting direction (upward in the drawing) (FIG. 3(*d*)).

Because the nozzle 16 is provided at the substantial center in the longitudinal direction of the ink flow path member 12, the ink which reaches the nozzle 16 is ejected from the nozzle 16 as an ink drop 2 as the ink flow path member 12 deforms in the ejecting direction due to this buckling reversal.

The speed of the deformation due to the buckling reversal is extremely large, as compared with displacement by a regular actuator or the like. Even the high viscosity inks used in the present invention can be sufficiently ejected as the ink drop 2.

Figure 4:
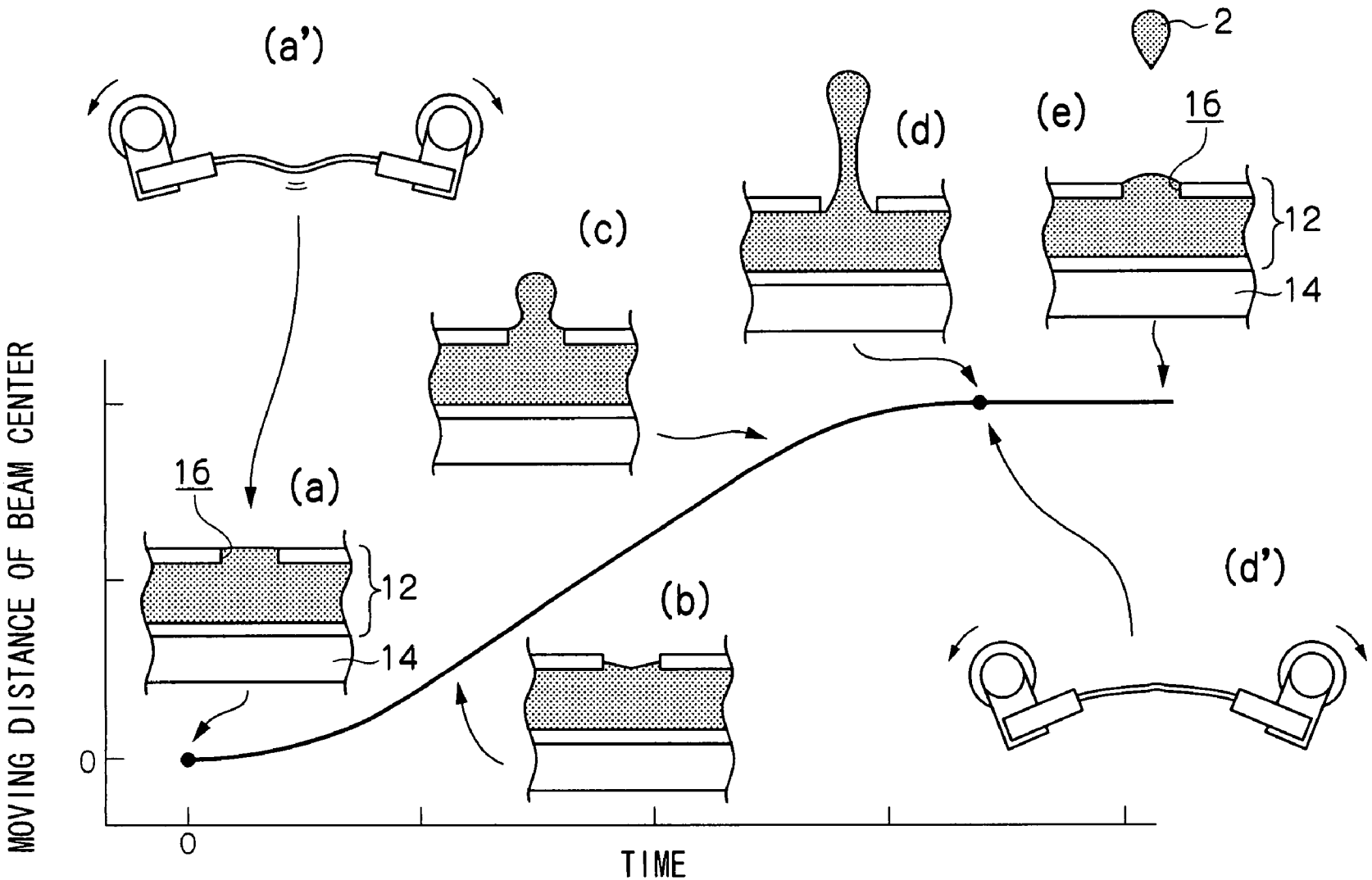
FIG. 4 is a drawing showing operation of the inkjet recording head relating to the first embodiment of the present invention.

The relationship between the displacement of the ink flow path member 12 (the beam member 14) and the ejecting of the ink drop 2 from FIG. 3(*c*) to FIG. 3(*d*), is shown in FIG. 4.

FIG. 4 shows the changes, in the moving distance in the vicinity of the nozzle 16 with respect to time, of the ink flow path member 12 (the beam member 14) from immediately before the buckling reversal occurs at the ink flow path member 12 to immediately after the ink drop is ejected.

Immediately before the buckling reversal occurs (a'), the beam member 14 is in a substantially static state with respect to the ink ejecting direction. Therefore, there is no change (a) in the liquid surface of the ink within the nozzle 16.

When the buckling reversal begins to occur (b), movement toward the ejecting direction starts suddenly. Therefore, due to inertia, the ink becomes a form which is pushed in the opposite direction, and the ink surface within the nozzle 16 becomes concave inwardly.

Deformation due to the buckling reversal continues as is, and shortly before the deformation of the beam member 14 becomes a maximum amount, the speed of displacement toward the ejecting direction begins to slow down (c). Due to inertia, the ink within the nozzle 16 advances in the ejecting direction at a uniform velocity, and therefore, the ink drop 2 starts to protrude from the nozzle 16 due to the difference in the speeds between the ink and the beam member 14.

When the deformation of the beam member 14 becomes the maximum amount, the displacement in the ejecting direction stops (d'). Therefore, only the ink drop 2 protrudes (d) from the nozzle 16, and the ink drop 2 is shot out (e) in the ejecting direction as is in accordance with the inertia.

The displacement from (a) to (e) due to the buckling reversal of the beam member 14 takes places over an extremely short time period. Therefore, an extremely good ejecting performance can be obtained in the present invention in which the viscosity of the ink is high. Further, even if the rotary encoder 20 is provided at only one of the holding members 18, the ink drop 2 can be ejected.

Specifically, an SUS plate of a thickness of 20 μm and a length 10 mm is used as the beam member 14, and a resin film of a thickness of 50 μm is used as the flow path member 12. After the flow path 13 is patterned by photolithography, the flow path member 12 is layered on and joined to the beam member 14. The width of the flow path 13 after the flow path member 12 is patterned is 50 μm. For the nozzle 16, a hole of Φ 30 μm is formed by laser machining in a polyimide film of a thickness of 25 μm. The films are joined by using an epoxy adhesive, and this structure is joined by an epoxy adhesive to the holding members 18 which are manufactured as rigid bodies.

The rotary encoder 20 and the holding member 18 are joined together in a state in which the holding member 18 is offset by 2.5 mm from the rotational center of the rotary encoder 20. When the ink is to be ejected (at the time of the buckling reversal of the beam member), the rotary encoders 20 are rotated −5° to +20°. At this time, the central portion of the beam member 14 moves about 1 mm at a speed of about 10 m/s in the ink ejecting direction. An ink, which is prepared to have a viscosity of 50 cps by increasing the mixing ratio of glycerin, is ejected from the nozzle 16 as the ink drop 2 of a diameter of about 25 μm. Ink of a viscosity of 100 cps is ejected as the ink drop 2 of a diameter of about 20 μm.

In an ejecting experiment, the ejecting cycle is driven at 3 Hz, and the ink drop 2 is observed by a stroboscopic method. When the rotational angles of the rotary encoders 20 are increased to rotation of −5° to +30°, the ejected ink amount increases, and ink of a viscosity of 50 cps is ejected as the ink drop 2 of a diameter of about 30 μm, and ink of a viscosity of 100 cps is ejected as the ink drop 2 of a diameter of about 25 μm.

The present method, which utilizes the buckling bending reversal of the beam member 14 and ejects the ink drop 2 by inertia as described above, can eject, without heating, inks of high viscosities of 50 to 100 cps, which has been extremely difficult in the conventional art.

Further, the ejecting/not ejecting of the ink drop 2 (whether buckling reversal occurs/does not occur) can be controlled by the amount of rotation and compression applied to the beam member 14, i.e., the rotational angle of the rotary encoders 20. Moreover, the magnitude of the inertia applied to the ink can be varied in accordance with the amount of rotation and compression applied to the beam member 14, and the liquid amount of the ejected ink drop 2 can be changed.

Figure 5A:
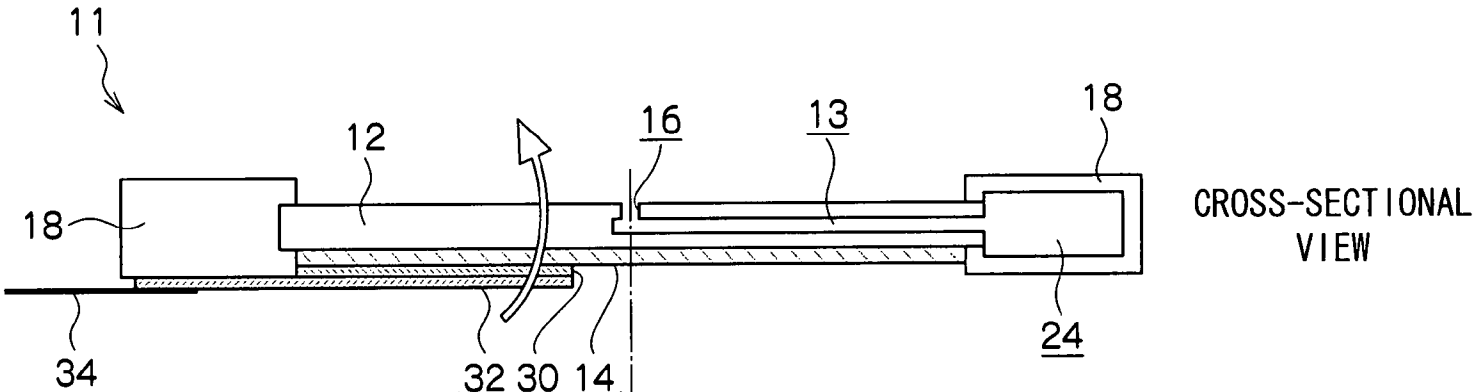
FIGS. 5A and 5B are drawings showing an inkjet recording head relating to a second embodiment of the present invention.
Figure 5B:
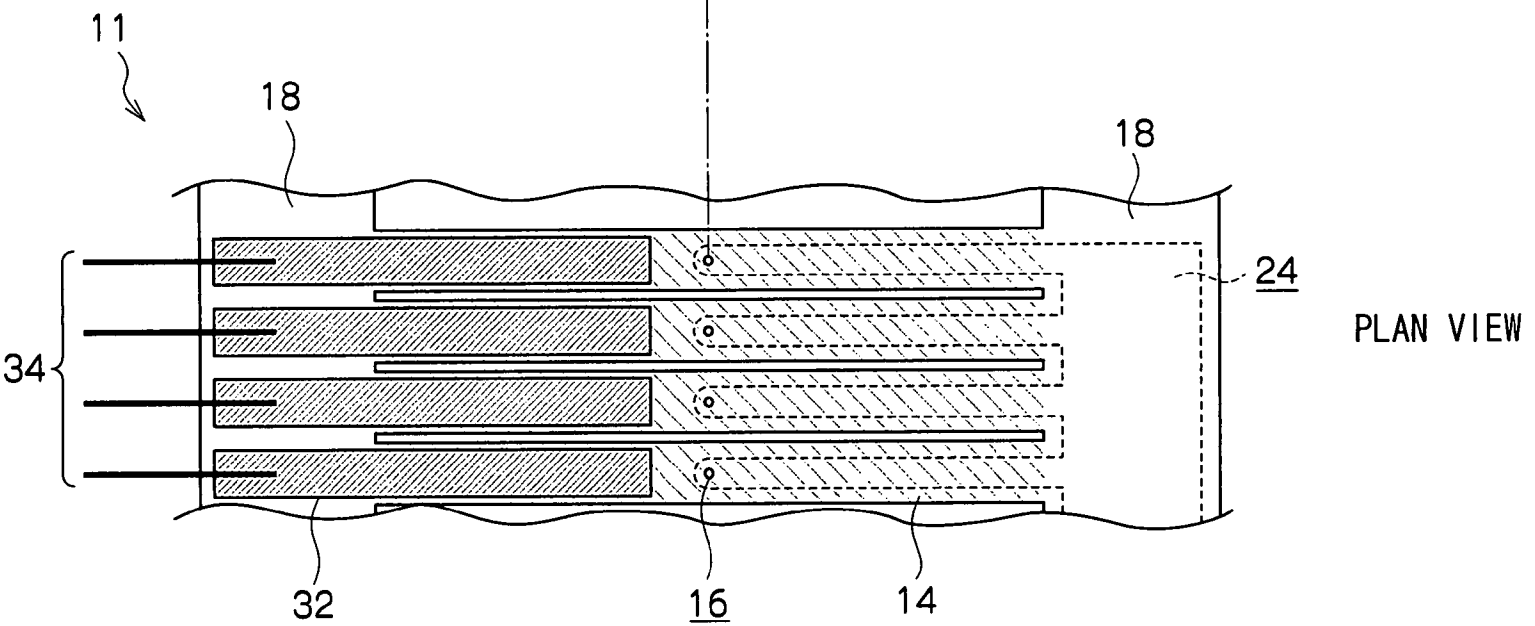

An inkjet recording head relating to a second embodiment of the present invention is shown in FIGS. 5A and 5B.

As shown in FIGS. 5A and SB, an inkjet recording head 11 is structured such that the ink flow path member 12 and the beam member 14 are joined together, and the holding members 18 support the both ends thereof. The ink flow path member 12 has the ink flow path 13 at the interior thereof, and has the nozzle 16 at the substantial center in the longitudinal direction thereof. The beam member 14 supports the ink flow path member 12. The ink flow path member 12 can flex in the ink ejecting direction (the direction of the white arrow in FIG. 5A) and the direction opposite thereto. The ink flow path member 12 ejects ink, which is supplied from the ink pool 24 and passes through the ink flow path 13 and reaches the nozzle 16, as an ink drop in the ejecting direction by inertia.

A piezo element 30 is joined to the beam member 14 up to substantially one-half at one side thereof in the longitudinal direction. Force in the bending direction is applied to the beam member 14 by the piezo element 30, so as to flex, in the ink ejecting direction or the direction opposite thereto, the beam member 14 and the ink flow path member 12 joined to the beam member 14.

An individual electrode 32 is formed at the piezo element 30, and a signal wire 34 is provided at the piezo element 30. The signal wire 34 is connected to a switching IC (not shown), and control of ejecting/not ejecting the ink drop is received by on/off control.

The beam member 14 also serves as the common electrode of the piezo element 30, and is connected to the piezo element 30 at one side and is connected to a power source (not shown) at the other side. The piezo element 30, the individual electrode 32, and the beam member 14 together can be handled as an actuator 36.

Actual operation will be described hereinafter.

Figure 6:
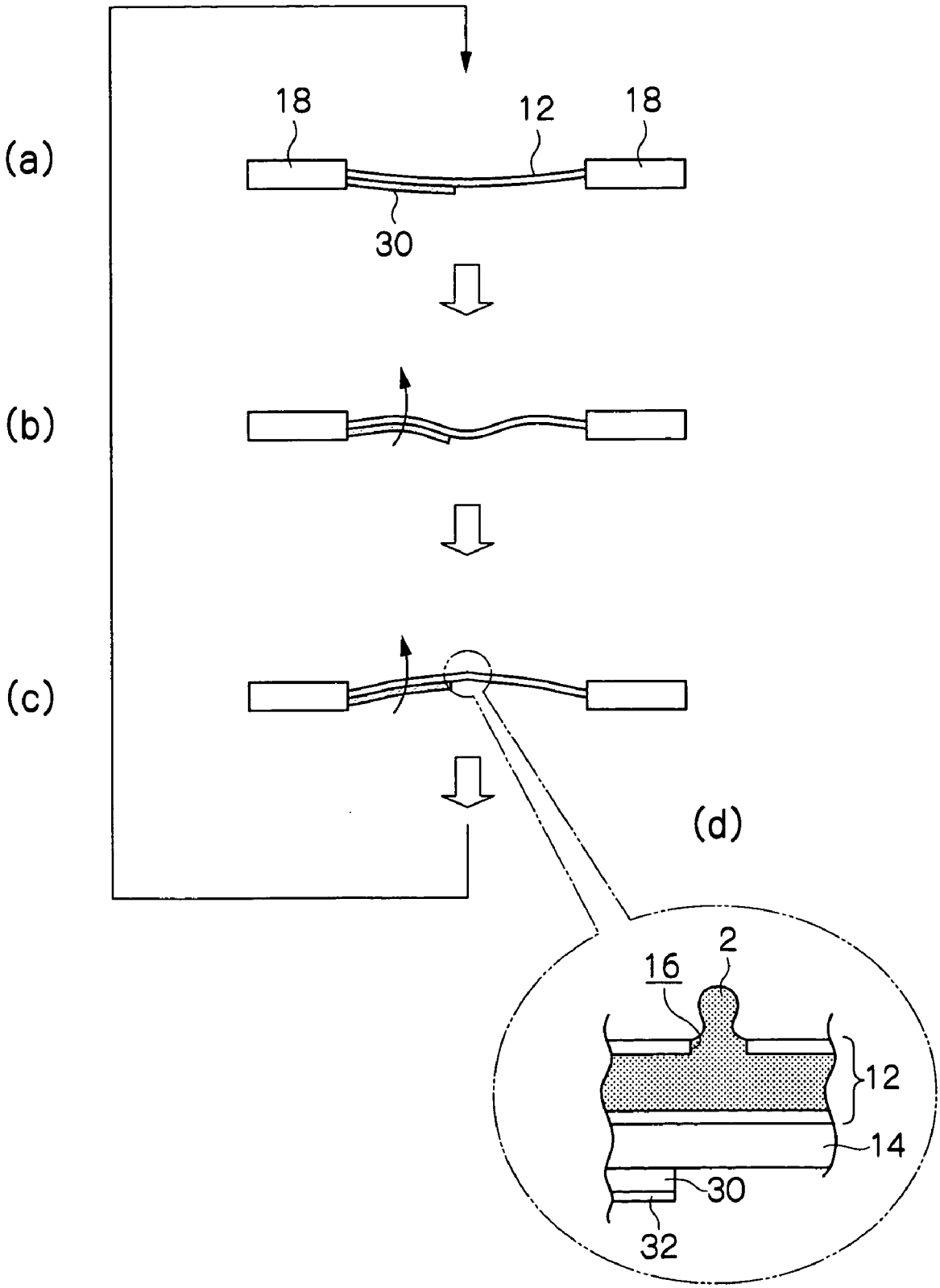
FIG. 6 is a drawing showing operation of the inkjet recording head relating to the second embodiment of the present invention.

The operation of the inkjet recording head relating to the second embodiment of the present invention is shown in FIG. 6.

As shown in FIG. 6(*a*), the ink flow path member 12 (the beam member 14 and the like are omitted) is held in a state of being flexed in advance in the direction opposite to the ink ejecting direction (i.e., downward in the figure).

Here, the piezo element 30 (the other elements structuring the actuator 36 are omitted) is driven by a signal from the switching IC (not illustrated), and the ink flow path member 12 is flexed in the ink ejecting direction (upward in the figure) (see FIG. 6(*b*)).

In this way, the ink flow path member 12 starts to flex in the ink ejecting direction (upward in the figure) from the both end portions thereof which are held at the holding members 18. At this stage, a vicinity of the center where the nozzle 16 is provided becomes convex toward the direction opposite the ejecting direction (i.e., downward in the figure), namely, becomes concave in the ejecting direction.

The deformation due to the piezo element 30 proceeds further, and when the ink flow path member 12 bucklingly reverses in the ink ejecting direction (FIG. 6(*c*)), the flexing direction of the ink flow path member 12 gradually changes to convex in the ejecting direction (upward in the figure), from near the holding members 18. When this change approaches the center from the both ends, a sharp buckling reversal occurs at the ink flow path member 12 (or the beam member 14) at a given point, and the ink flow path member 12 (or the beam member 14) suddenly deforms in the ink ejecting direction (upward in the drawing).

Because the nozzle 16 is provided at the substantial center in the longitudinal direction of the ink flow path member 12, the ink which reaches the nozzle 16 is ejected (FIG. 6(*d*))

from the nozzle 16 as the ink drop 2 as the ink flow path member 12 deforms in the ejecting direction due to this buckling reversal.

The speed of the deformation due to the buckling reversal is extremely large, as compared with displacement by a regular actuator or the like. Even the high viscosity inks used in the present invention can be sufficiently ejected as the ink drop 2. Namely, even though the displacement by the actuator 36 is slow, the deformation by the buckling reversal is sufficiently fast, and the ink drop 2 can be ejected from the nozzle 16 even if a high viscosity ink is used.

In the present embodiment, the control of ejecting/not ejecting the ink drop 2 is merely the on/off of the signal to the piezo element 30. Therefore, the inkjet recording head which ejects high viscosity ink can be formed by a simple structure.

Figure 7:
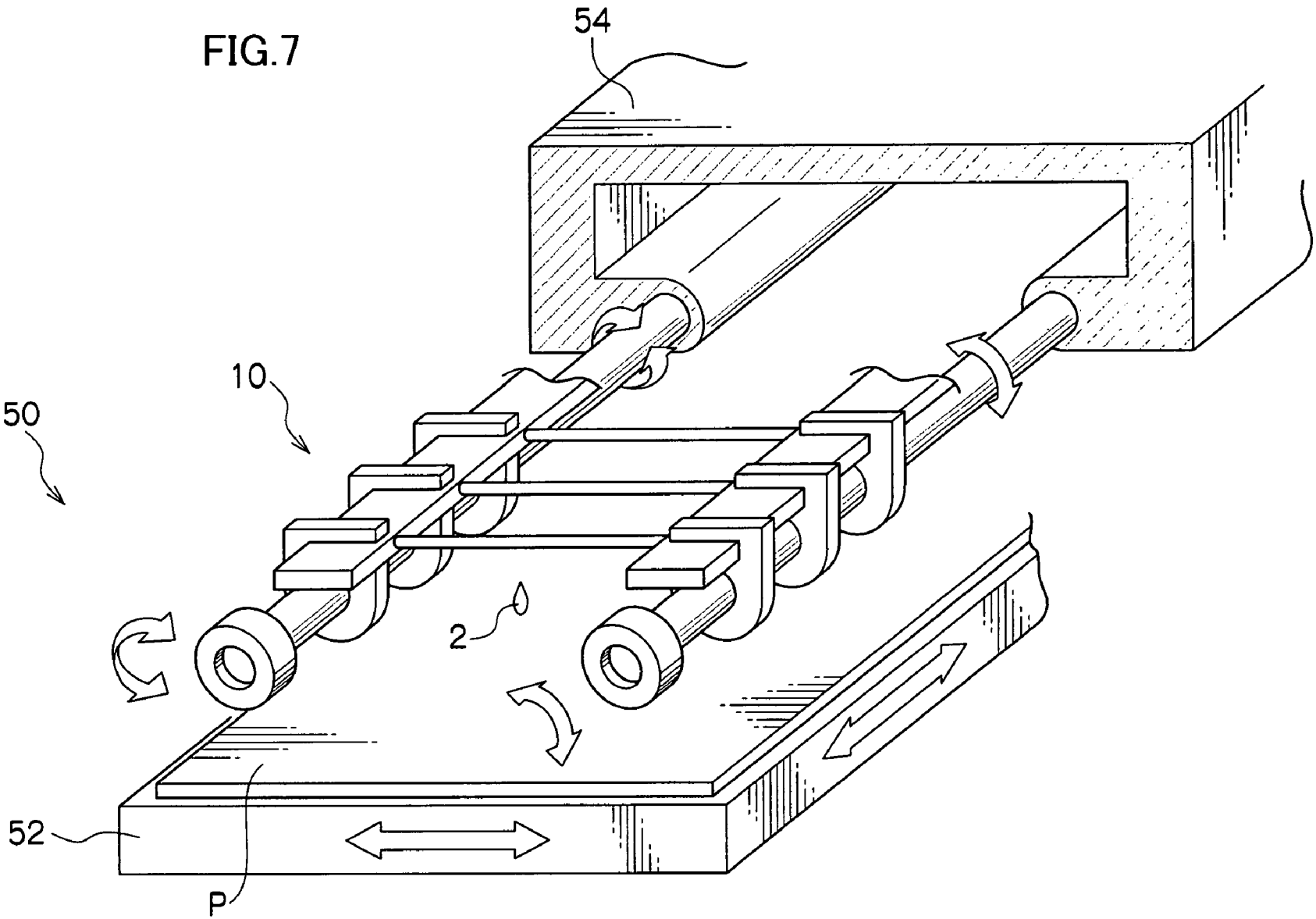
FIG. 7 is a drawing showing an inkjet recording device relating to the present invention.
Figure 8A:
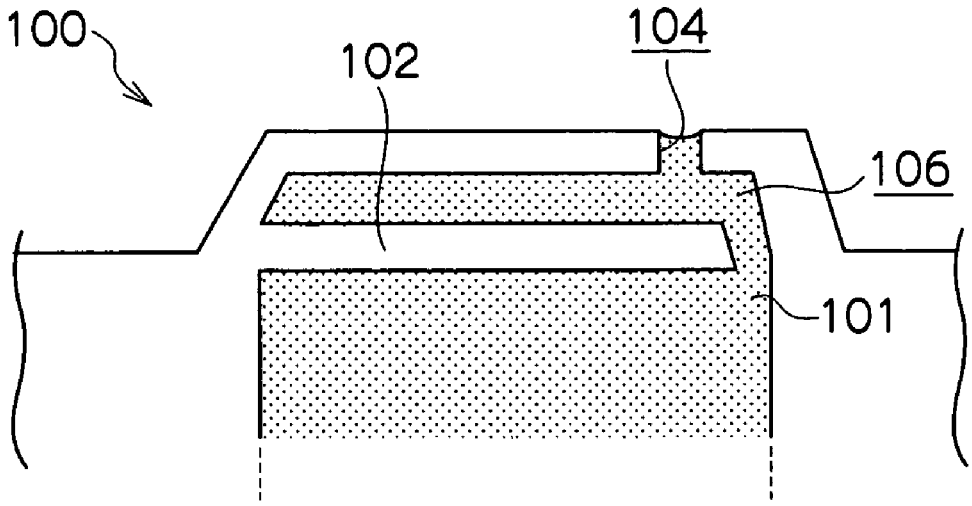
FIG.8A RELATED ART
FIGS. 8A and 8B are drawings showing an inkjet recording head of the related art.
Figure 8B:
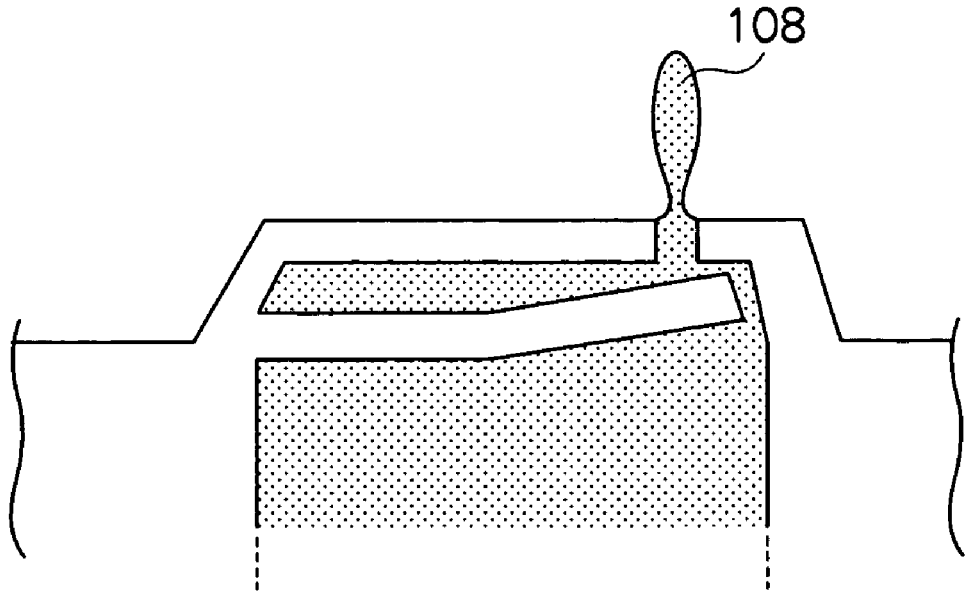
FIG.8B RELATED ART

An inkjet recording device using the inkjet recording head relating to the present invention is shown in FIG. 7.

As shown in FIG. 7, an inkjet recording device 50 has a head supporting member 54. The inkjet recording head 10 or 11 of the present invention is held at the head supporting member 54. The head supporting member 54 is structured so as to hold the inkjet recording head 10 or 11, and so as not to obstruct the ink ejecting operation. A table 52, on which is placed and which holds a recording medium P, is provided beneath the head supporting member 54.

The recording medium P is set on the table 52, the table 52 is moved within a plane in the X and Y directions (the directions indicated by the white arrows in FIG. 7), the inkjet recording head 10 or 11 is driven, and the ink drops 2 of a high viscosity ink are ejected. Because a high viscosity ink is used as described above, bleeding of the ink drop 2 when the ink drop 2 lands on the recording medium P can be prevented, and high-quality recording can be carried out.

Note that the present invention is not limited to the above-described embodiments.

For example, the actuator is structured by the piezo element 30 and the beam member 14 in the above-described embodiment. However, the actuator may be an actuator which, instead of the piezo element 30, uses a heating resistor, and flexurally deforms due to the difference in thermal expansions. Or, the actuator may be an actuator utilizing static electricity or magnetic force. Or, another type of actuator may be used.

In the above-described embodiments, the nozzle 16 and the ink flow path 13 are formed by respectively independent resin films which are adhered and joined together, but the present invention is not limited to the same. For example, the nozzle and the ink supply path may be formed integrally. Or, the beam member 14 may also be structured integrally therewith. Or, another form may be used.

In the above-described embodiments, the inkjet recording head 10 or 11 is fixed, and recording is carried out while moving the recording medium P. However, for example, the recording medium P may be fixed, and the inkjet recording head 10 or 11 may be installed at a carriage, and recording may be carried out while conveying the inkjet recording head 10 or 11, or recording may be carried out while conveying both the recording medium P and the inkjet recording head 10 or 11. Or, a structure may be used in which the recording medium P is trained around a drum and rotated.

The inkjet recording in the present specification is not limited to the recording of characters or images onto recording paper. Namely, the recording medium is not limited to paper, and the liquid which is ejected is not limited to ink. For example, the present invention can be applied to liquid drop jetting devices in general which are used industrially, such as in fabricating color filters for displays by ejecting ink onto a high polymer film or glass, or in forming bumps for parts assembly by ejecting solder in a liquid state onto a substrate, or the like.

In the present invention, the inkjet recording head may have the beam member which is joined to the ink flow path member or includes the ink flow path member, and after the driving section elastically bendingly deforms the beam member such that the beam member becomes concave in the ink drop ejecting direction, the driving section may bucklingly reversely deform the beam member such that the beam member becomes convex in the ink drop ejecting direction, and may apply the inertia in the ejecting direction to the ink in a vicinity of the nozzle, and may make the ink drop be ejected from the nozzle.

In the above-described structure, by bucklingly deforming the beam member, which is integral with the ink flow path member, from concave to convex in the ejecting direction, the ink drop is inertially released all at once, and can be ejected at high speed.

In the present invention, at the inkjet recording head, the driving section may hold one longitudinal direction end of the beam member or both longitudinal direction ends of the beam member so as to be freely rotatable in the ink drop ejecting direction, and after compressing the beam member in a longitudinal direction of the beam member so that the beam member becomes concave in the ink drop ejecting direction, may rotate the one longitudinal direction end of the beam member or the both longitudinal direction ends of the beam member so as to bucklingly reversely deform the beam member such that the beam member becomes convex in the ink drop ejecting direction, and may apply the inertia in the ejecting direction to the ink in the vicinity of the nozzle, and may make the ink drop be ejected from the nozzle.

In the above-described structure, the beam member, which is preliminarily deformed so as to be concave in the ejecting direction, is bucklingly reversed convexly by the driving section, and made to eject the ink drop. In this way, the absence/presence of the buckling reversal, i.e., the absence/presence of ejecting of the ink drop, can be controlled by the absence/presence of the preliminary deformation.

In the present invention, at the inkjet recording head, a moving distance of the beam member in the ink drop ejecting direction in a vicinity of the nozzle may be controlled by changing an angle of rotation of the rotary encoder, and a size of an ejected ink drop may be controlled by controlling a magnitude of the inertia applied to the ink in the vicinity of the nozzle by a length of the moving distance.

In the above-described structure, the magnitude of the inertia applied to the ink drop, i.e., the size of the ink drop, can be controlled by the amount of compression applied to the beam member, i.e., the amount of rotation of the encoder.

In the present invention, at the inkjet recording head, the actuator may be provided along substantially one-half of a longitudinal direction length of the beam member.

In the above-described structure, by making the actuator be a length which is substantially one-half of that of the beam member, the actuator can be prevented from breaking at the beam central portion where the flexure of the buckling reversal is the greatest. The place where the buckling deformation is caused can be restricted to a vicinity of the center of the beam member.

In the present invention, at the inkjet recording head, the actuator may be a piezo actuator.

In the above-described structure, a piezo element, by which a large displacement can be obtained, is used as an actuator which has a relatively slow response speed and is therefore good. In this way, an inkjet recording head which is inexpensive and reliable can be obtained.

Because the present invention has the above-described structure, it is possible to obtain an inkjet recording head and an inkjet recording device which can eject a high viscosity ink at ordinary temperature.

What is claimed is:

1. An inkjet recording head comprising:

a nozzle portion ejecting an ink drop;

an ink flow path member including the nozzle portion;

a driving section moving the ink flow path member in an ink drop ejecting direction and an opposite direction; and a beam member joined to the ink flow path member, wherein the driving section moves the ink flow path member in the ink drop ejecting direction, and applies inertia in the ejecting direction to internal ink by one of suddenly stopping the ink flow path member and moving the ink flow path member in the opposite direction, and makes the ink drop be ejected from the nozzle portion, after the driving section elastically bendingly deforms the beam member such that the beam member becomes concave in the ink drop ejecting direction, the driving section bucklingly reversely deforms the beam member such that the beam member becomes convex in the ink drop ejecting direction, and applies the inertia in the ejecting direction to the ink in a vicinity of the nozzle portion, and makes the ink drop be ejected from the nozzle portion, and the driving section holds one of one longitudinal direction end of the beam member and both longitudinal direction ends of the beam member so as to be freely rotatable in the ink drop ejecting direction, and compresses the beam member in a longitudinal direction of the beam member so that the beam member becomes concave in the ink drop ejecting direction, and rotates the one of the one longitudinal direction end of the beam member and the both longitudinal direction ends of the beam member so as to bucklingly reversely deform the beam member such that the beam member becomes convex in the ink drop ejecting direction, and applies the inertia in the ejecting direction to the ink in the vicinity of the nozzle portion, and makes the ink drop be ejected from the nozzle portion.

2. The inkjet recording head of claim 1, wherein the beam member is structured so as to include the ink flow path member.

3. An inkjet recording head comprising:

a nozzle portion ejecting an ink drop;

an ink flow path member including the nozzle portion;

a beam member joined to the ink flow path member;

holding members holding both ends of the beam member; and a rotary encoder supporting one of the holding members or both of the holding members so as to be freely rotatable in an ink drop ejecting direction, and compressing and rotating the beam member, and supporting the holding member such that the holding member is offset from a rotational center of the rotary encoder, wherein, due to rotation of the rotary encoder, the beam member is bucklingly reversely deformed, and inertia in the ejecting direction is applied to ink within the ink flow path member, and the ink drop is ejected from the nozzle portion.

4. The inkjet recording head of claim 3, wherein a moving distance of the beam member in the ink drop ejecting direction in a vicinity of the nozzle portion is controlled by changing an angle of rotation of the rotary encoder, and a size of an ejected ink drop is controlled by controlling a magnitude of the inertia applied to the ink in the vicinity of the nozzle portion by a length of the moving distance.

5. The inkjet recording head of claim 3, wherein the beam member is structured so as to include the ink flow path member.

6. An inkjet recording device comprising an inkjet recording head, the inkjet recording head having:

a nozzle portion ejecting an ink drop;

an ink flow path member including the nozzle portion;

a driving section moving the ink flow path member in an ink drop ejecting direction and an opposite direction; and a beam member joined to the ink flow path member, wherein the driving section moves the ink flow path member in the ink drop ejecting direction, and applies inertia in the ejecting direction to internal ink by one of suddenly stopping the ink flow path member and moving the ink flow path member in the opposite direction, and makes the ink drop be ejected from the nozzle portion, after the driving section elastically bendingly deforms the beam member such that the beam member becomes concave in the ink drop ejecting direction, the driving section bucklingly reversely deforms the beam member such that the beam member becomes convex in the ink drop ejecting direction, and applies the inertia in the ejecting direction to the ink in a vicinity of the nozzle portion, and makes the ink drop be ejected from the nozzle portion, and the driving section holds one of one longitudinal direction end of the beam member and both longitudinal direction ends of the beam member so as to be freely rotatable in the ink drop ejecting direction, and compresses the beam member in a longitudinal direction of the beam member so that the beam member becomes concave in the ink drop ejecting direction, and rotates the one of the one longitudinal direction end of the beam member and the both longitudinal direction ends of the beam member so as to bucklingly reversely deform the beam member such that the beam member becomes convex in the ink drop ejecting direction, and applies the inertia in the ejecting direction to the ink in the vicinity of the nozzle portion, and makes the ink drop be ejected from the nozzle portion.

7. The inkjet recording device of claim 6, wherein the beam member is structured so as to include the ink flow path member.

8. An inkjet recording device comprising an inkjet recording head, the inkjet recording head having:

a nozzle portion ejecting an ink drop;

an ink flow path member including the nozzle portion;

a beam member joined to the ink flow path member;

holding members holding both ends of the beam member; and a rotary encoder supporting one of the holding members or both of the holding members so as to be freely rotatable in an ink drop ejecting direction, and compressing and rotating the beam member, and supporting the holding member such that the holding member is offset from a rotational center of the rotary encoder, wherein, due to rotation of the rotary encoder, the beam member is bucklingly reversely deformed, and inertia in the ejecting direction is applied to ink within the ink flow path member, and the ink drop is ejected from the nozzle portion.

9. The inkjet recording device of claim 8, wherein a moving distance of the beam member in the ink drop ejecting direction in a vicinity of the nozzle portion is controlled by changing an angle of rotation of the rotary encoder, and a size of an ejected ink drop is controlled by controlling a magnitude of the inertia applied to the ink in the vicinity of the nozzle portion by a length of the moving distance.

10. The inkjet recording device of claim 8, wherein the beam member is structured so as to include the ink flow path member.

* * * * *